US009911569B2

(12) United States Patent
van der Borst et al.

(10) Patent No.: US 9,911,569 B2
(45) Date of Patent: Mar. 6, 2018

(54) X-RAY TUBE ANODE ARRANGEMENT

(71) Applicant: Malvern Panalytical B.V., Almelo (NL)

(72) Inventors: J. van der Borst, Almelo (NL); Bart Filmer, Almelo (NL); Ben Hageluken, Almelo (NL); Jos Schalley, Almelo (NL); Romulus Mihalca, Almelo (NL)

(73) Assignee: Malvern Panalytical B.V., Almelo (NL)

( * ) Notice: Subject to any disclaimer, the term of this patent is extended or adjusted under 35 U.S.C. 154(b) by 101 days.

(21) Appl. No.: 14/993,163

(22) Filed: Jan. 12, 2016

(65) Prior Publication Data

US 2016/0203939 A1 Jul. 14, 2016

(30) Foreign Application Priority Data

Jan. 12, 2015 (EP) ..... 15150816

(51) Int. Cl.

| | |
|---|---|
| ***H01J 35/18*** | (2006.01) |
| ***H01J 35/08*** | (2006.01) |
| ***H01J 9/14*** | (2006.01) |
| ***H01J 35/12*** | (2006.01) |

(52) U.S. Cl.

CPC ..... *H01J 35/08* (2013.01); *H01J 9/14* (2013.01); *H01J 35/12* (2013.01); *H01J 2235/084* (2013.01); *H01J 2235/1204* (2013.01); *H01J 2235/1262* (2013.01)

(58) Field of Classification Search

CPC ..... H05G 2/003; H05G 2/008; H05G 2/001; B82Y 10/00; G03F 7/7003; H01J 2235/186; H01J 35/105; H01J 35/12; H01J 2235/1204; H01J 2235/183; H01J 35/108

USPC ..... 378/142, 119, 121, 144, 127, 143

See application file for complete search history.

(56) References Cited

U.S. PATENT DOCUMENTS

| | | | | |
|---|---|---|---|---|
| 2,387,903 | A | 10/1945 | Hensel | |
| 5,509,046 | A | 4/1996 | Logan | |
| 9,008,278 | B2 * | 4/2015 | Lee | H01J 5/18 378/124 |
| 2012/0106711 | A1 | 5/2012 | Allen et al. | |
| 2012/0134467 | A1 | 5/2012 | Whittum et al. | |
| 2014/0177801 | A1 * | 6/2014 | Lee | G01N 23/207 378/73 |

(Continued)

OTHER PUBLICATIONS

Mel Schwartz: "Brazing Second Edition" In: "Brazing Second Edition", Jan. 1, 2003 (Jan. 1, 2003), ASM International, XP055201556, pp. 97-97, p. 97; table 4.11.

*Primary Examiner* — Don Wong

(74) *Attorney, Agent, or Firm* — Leason Ellis LLP

(57) ABSTRACT

A method of manufacturing an X-ray tube component, includes diffusion bonding or brazing an anode of rhodium, molybdenum or tungsten to a heat spreader of molybdenum, tungsten, or a composite of molybdenum and/or tungsten. Suitable joint materials for diffusion bonding include gold; suitable joint materials for brazing include an alloy of silver and copper, an alloy of silver, copper and palladium, an alloy of gold and copper or an alloy of gold, copper and nickel. The resulting tube component delivers reliable behaviors and the joint can withstand high temperatures, high temperature gradients, fast temperature changes, extremely high radiation and extremely high electric field, while maintaining good high vacuum properties.

12 Claims, 3 Drawing Sheets

(56) References Cited

U.S. PATENT DOCUMENTS

2014/0185778 A1* 7/2014 Lee ..... H01J 5/18
378/124

* cited by examiner

X-RAY TUBE ANODE ARRANGEMENT

CROSS-REFERENCE TO RELATED APPLICATIONS

The present application claims priority under 35 U.S.C. § 119 to European Patent Application No. 15150816.5, filed Jan. 12, 2015, which is hereby incorporated by reference in its entirety.

FIELD OF INVENTION

The invention relates to a method of making an X-ray tube anode arrangement, the resulting anode arrangement and an X-ray tube including such an anode arrangement.

BACKGROUND TO THE INVENTION

X-ray tubes include an anode. High energy electrons impact the anode driven by a voltage drop between the anode and a cathode. A small part of the energy of the high energy electrons is converted into X-rays. The rest of the energy must be removed by cooling.

This cooling may be carried out using a heat spreader. The overall heat transfer coefficient is important. Therefore, heat spreader materials with a high thermal conductivity are necessary to keep the anode temperature as low as possible. As the power of the X-ray tube rises, high temperatures cannot be avoided. It is still however necessary to keep the anode temperature low enough to prevent evaporation or melting of the anode material.

Thus, the environment of the anode in an X-ray tube can be very harsh-temperatures can be high and x-ray intensities also very high. It is necessary to maintain good anode function in this harsh environment. In particular the harsh environment does not simply include high temperatures of 800° C. or higher but also high temperature gradients.

Conventional heat spreader materials are copper or silver which are selected because of their high heat conductivity. However, such materials can have thermal expansion mismatches with the anode material which can lead to high stresses.

Selection of alternative materials is not easy, since it is not sufficient to simply choose another heat spreader material. It is also necessary to fix the anode securely to the heat spreader in such a way that the anode remains firmly attached with a low thermal resistance even in the challenging environment of an X-ray tube, and suitable ways of fixing the anode have not been previously identified. Accordingly, X-ray tubes continue to use copper or silver heat spreaders.

SUMMARY OF THE INVENTION

According to the invention, there is provided a method of manufacturing an X-ray tube anode arrangement, comprising: providing an anode of rhodium, molybdenum or tungsten; providing a heat spreader of a composite of molybdenum and/or tungsten; mounting the anode on the heat spreader with a layer of joint material therebetween; and bonding the anode to the heat spreader with the joint material.

The applicants have found that in this way it is possible to implement an x-ray anode arrangement with good heat sinking properties which is also highly reliable. In particular the anode arrangement can withstand high temperatures, high temperature gradients, fast temperature changes, extremely high radiation and extremely high electric field, while maintaining good high vacuum properties.

The anode arrangement can withstand rapid high power switches significantly better than with a conventional anode on a conventional silver or copper heat spreader.

Note that the term "composite" may include a mixture or an alloy as well as other forms such as a laminate. The term "alloy" here is not intended to suggest that copper and molybdenum and/or tungsten dissolve in each other.

The heat spreader may be a composite of molybdenum and copper or tungsten and copper.

The step of bonding the anode to the heat spreader may include diffusion bonding the anode to the heat spreader. The joint material may be gold.

Experiments presented below demonstrated excellent results with such an approach.

The joint material may be a thin layer of thickness 5 to 200 μm.

As an alternative to diffusion bonding, the step of bonding the anode to the heat spreader involves brazing the anode to the heat spreader, i.e. softening the joint material by greater heat than used for diffusion bonding.

Suitable joint materials for brazing include an alloy of silver and copper, an alloy of silver, copper and palladium, an alloy of gold and copper or an alloy of gold, copper and nickel.

In another aspect, the invention relates to an X-ray tube anode arrangement, comprising:

- an anode of rhodium, molybdenum or tungsten;
- a heat spreader of a composite of molybdenum and/or tungsten having a matching thermal expansion coefficient to the anode; and
- a joint layer of gold, silver, or an alloy of gold or silver bonding the anode to the heat spreader.

Such an X-ray tube anode arrangement may have excellent reliability and be capable of high power operation.

The joint layer may be a layer of gold of thickness 5 to 200 μm.

Alternatively, the joint layer may be an alloy of silver and copper, or an alloy of silver, copper and palladium, an alloy of gold and copper or an alloy of gold, copper and nickel.

In a yet further aspect, the invention may relate to an X-ray tube having an X-ray tube anode arrangement as discussed above.

BRIEF DESCRIPTION OF THE DRAWINGS

An example of the invention will now be described with reference to the accompanying diagrams, in which.

DETAILED DESCRIPTION

Figure 1:
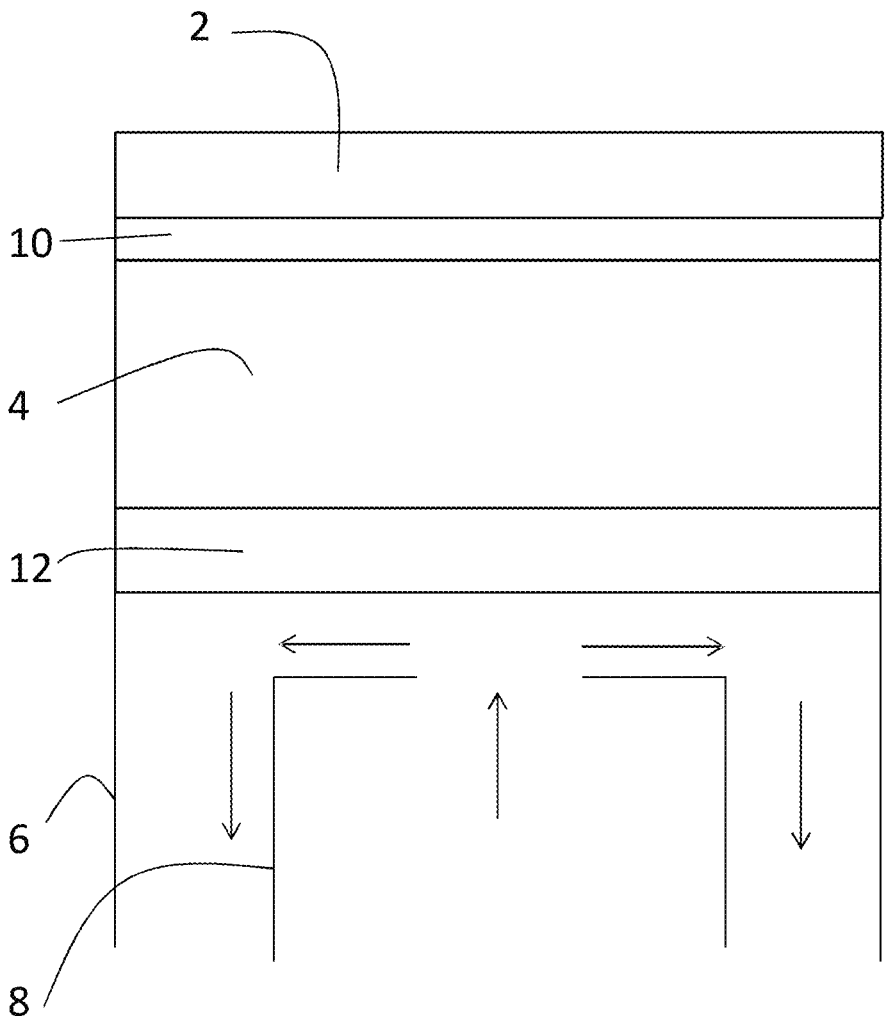
FIG. 1 is a cross section through an X-ray tube anode arrangement according to an embodiment of the invention.

Referring to FIG. 1, an X-ray tube anode arrangement includes anode 2 is made of rhodium mounted on a heat spreader 4. On the rear of the heat spreader there is provided a cooling arrangement 6,8.

The heat spreader 4 is made of an alloy of molybdenum and copper, having an alloy composition chosen so that the thermal expansion coefficient matches the thermal expansion coefficient of rhodium.

The inventors have tested a number of different approaches to fixing the anode to the heat spreader. Good results have been obtained using a diffusion bond of gold. Thus, a bonding layer of joint material 10, in this case of gold, is provided between the anode 2 and the heat spreader 4 to firmly fix the anode to the heat spreader.

The layer of joint material may have a thickness of 5 to 200 μm, in embodiments 10 to 100 μm for example 50 μm.

A layer of corrosion resistant material 12 is provided on the rear of the heat spreader to avoid corrosion of the heat spreader 4. The corrosion resistant material 12 may be, for example, gold.

The cooling arrangement 6,8 is formed by a pair of concentric tubes 6,8, an outer tube 6 around an inner tube 8. The end of the tubes are closed with the corrosion resistant material 12 on heat spreader 4. A coolant, for example deionised water, is used to transport heat in the cooling arrangement.

In use, water is pumped along the inner tube 8 in the direction indicated by arrows, then flows across the corrosion resistant material 12 on heat spreader 4 where it takes heat from the heat spreader 4 and then is removed along a flow path between the inner 8 and outer 6 tubes. A circuit for the coolant is completed by a pump, filter, heat exchanger and stock barrel, which cools and recirculates the water.

To manufacture the X-ray tube anode arrangement, the anode 2 and heat spreader 4 are brought together with the bonding layer in the form of a sheet of joint material 10 between them. The anode 2 is then diffusion bonded to the heat spreader 4 by heating under pressure, but not to a temperature where the gold melts. This creates a diffusion bond.

In a specific embodiment, the diffusion bonding was carried out at a temperature between 700° C. and 950° C., for example 800° C., for between 15 minutes and 200 minutes, for example 120 minutes (two hours) in a forming gas atmosphere. The pressure used may be 10 bar to 500 bar, for example 80 bar; higher pressures may also be used. There is a trade off between temperature and time and higher temperatures may be used, for example, for shorter periods of time.

Finite element analysis has been carried out to calculate the plastic deformation of the resulting anode arrangement in use compared with a comparative example of the same anode attached to a silver heat spreader. See the results presented in FIGS. 2 and 3. The drawings show deformation—the darker the region the more deformation there.

Figure 3:
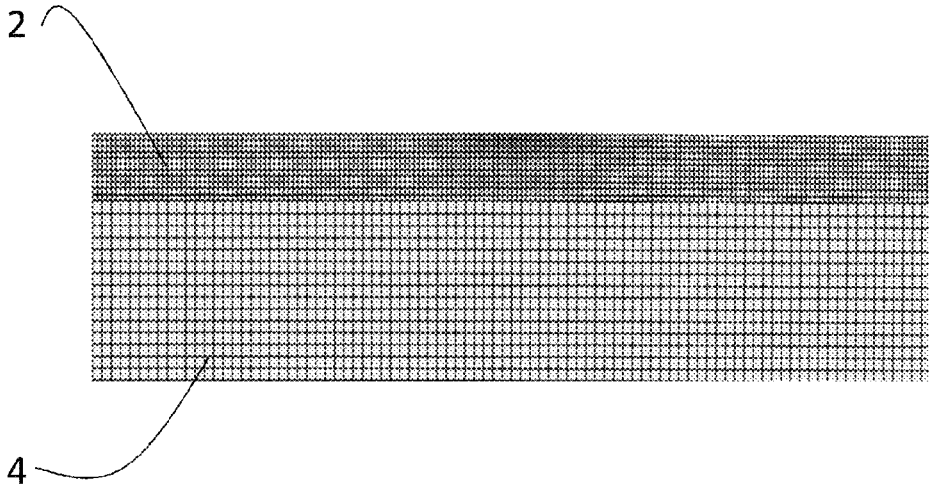
FIG. 3 shows a finite element analysis of an X-ray tube anode arrangement according to an embodiment.

Referring to FIG. 3, the embodiment, little plastic deformation is observed. This anode arrangement only has plastic deformation in the surface of the anode material, not in the heat spreader. This does not have a significant impact on the life of the X-ray tube.

Figure 2:
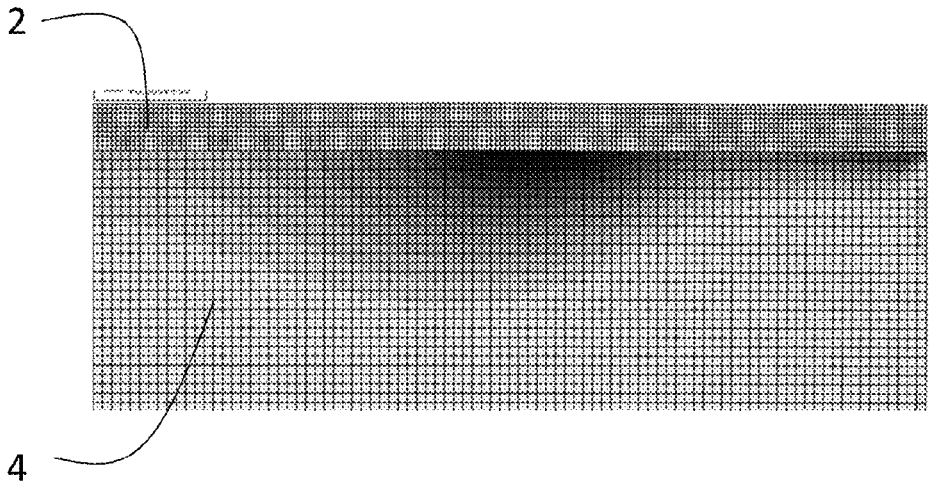
FIG. 2 shows a finite element analysis of an X-ray tube anode arrangement according to a comparative example.

In contrast, referring to FIG. 2, the anode arrangement according to a comparative example has plastic deformation not merely in the anode but also in the heat spreader. This can materially affect the lifetime of the X-ray tube in use.

The joint in the anode arrangement in particular could withstand:

high temperatures of 850° C.;
extreme temperature gradients of 100° C./mm,
fast temperature changes of 100° C./s;
extremely high radiation of 10 Sv/s; and
extremely high electric fields of 15 kV/mm.

Figure 4:
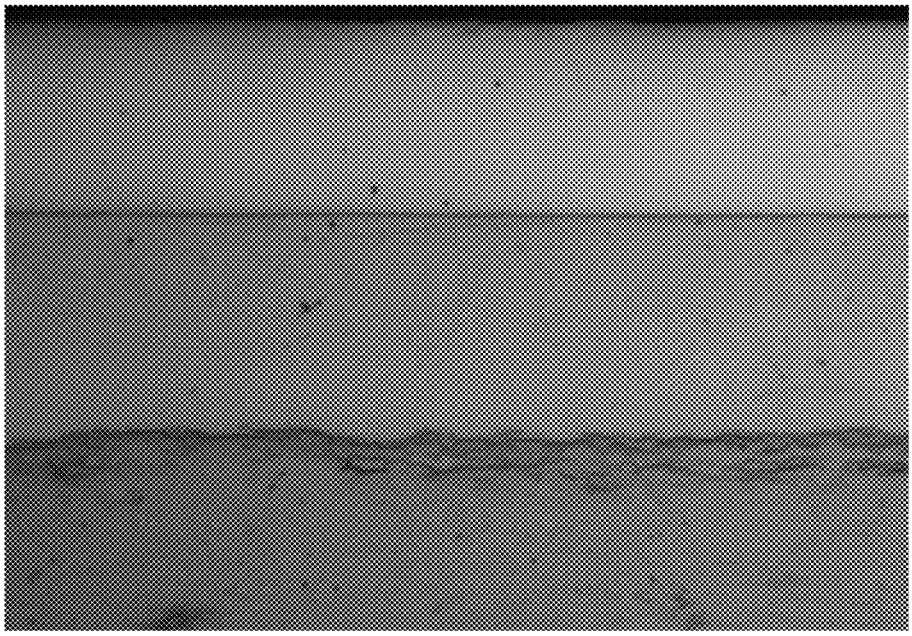
FIG. 4 is a photomicrograph of a join in an X-ray tube anode arrangement according to an embodiment of the invention.

Further, a section through a joint as illustrated in the photomicrogrpah of FIG. 4 shows a bond with a rhodium anode as the top layer on a 50 μm layer of gold on a composite of molybdenum and copper. The result shown is an excellent bond, free of voids and cracks and with a complete contact between the different materials.

Prototype X-ray tubes were made with the new anode construction and these were able to withstand an increase in the number of power switches before tube failure of a factor of 2 compared with the comparative example. The invention accordingly delivers surprisingly good results in terms of improved tube life and performance.

Thus, the inventors have discovered how to reliably bond anodes of rhodium, molybdenum or tungsten to produce reliable joints in the extreme operating conditions of an X-ray tube.

In alternative embodiments, different anode materials are used, in particular the anode may be of molybdenum or tungsten.

As an alternative to diffusion bonding, brazing may also be used. In such a case, a metal layer of copper silver alloy or palladium copper silver alloy may be used. Such alloys are commercially available as "Cusil" or "Pacusil" respectively.

Before brazing, it may be advantageous to coat either the anode, the heat spreader or both with a thin layer of nickel or gold plate before brazing.

The invention claimed is:

1. A method of manufacturing an X-ray tube component, comprising:

providing an anode of rhodium, molybdenum or tungsten;
providing a heat spreader of a composite of molybdenum and/or tungsten having a matching thermal expansion coefficient to the anode;
mounting the anode on the heat spreader with a layer of joint material therebetween, the joint material being gold or an alloy of gold;
bonding the anode to the heat spreader with the joint material;
wherein the step of bonding the anode to the heat spreader involves diffusion bonding the anode to the heat spreader.

2. The method according to claim 1, wherein the joint material is gold.

3. The method according to claim 1, wherein the joint material is a thin layer of thickness 5 to 200 μm.

4. The method according to claim 1, wherein the step of bonding the anode to the heat spreader involves brazing the anode to the heat spreader.

5. The method according to claim 4, wherein the joint material is an alloy of gold and copper or an alloy of gold, copper and nickel.

6. The method according to claim 1, wherein the heat spreader is a composite of molybdenum and copper or a composite of tungsten and copper.

7. An X-ray tube component, comprising:

an anode of rhodium, molybdenum or tungsten;
a heat spreader of a composite of molybdenum and/or tungsten having a matching thermal expansion coefficient to the anode; and
a bonding layer of gold or an alloy of gold diffusion bonding the anode to the heat spreader.

8. The X-ray tube component according to claim 7, wherein the bonding layer has a thickness 5 to 200 μm.

9. The X-ray tube component according to claim 7, wherein the bonding layer is gold.

10. The X-ray tube component according to claim 7, wherein the bonding layer is an alloy of gold and copper or an alloy of gold, copper and nickel.

11. The X-ray tube component according to claim 7, wherein the heat spreader is a composite of molybdenum and copper or a composite of tungsten and copper.

12. An X-ray tube comprising an X-ray tube component according to claim 7.

* * * * *